US010850371B2

(12) United States Patent
Xu et al.

(10) Patent No.: US 10,850,371 B2
(45) Date of Patent: Dec. 1, 2020

(54) ANVIL FOR AN IMPACT WRENCH

(71) Applicant: MILWAUKEE ELECTRIC TOOL CORPORATION, Brookfield, WI (US)

(72) Inventors: Wei Chao Xu, Dongguan (CN); Guang Hu, Dongguan (CN)

(73) Assignee: Milwaukee Electric Tool Corporation, Brookfield, WI (US)

( * ) Notice: Subject to any disclaimer, the term of this patent is extended or adjusted under 35 U.S.C. 154(b) by 124 days.

(21) Appl. No.: 16/267,791

(22) Filed: Feb. 5, 2019

(65) Prior Publication Data

US 2019/0247985 A1 Aug. 15, 2019

(30) Foreign Application Priority Data

Feb. 9, 2018 (CN) ..... 2018 1 0134022

(51) Int. Cl.
*B25B 21/02* (2006.01)
*B25D 17/06* (2006.01)

(52) U.S. Cl.
CPC ..... *B25B 21/02* (2013.01); *B25B 21/026* (2013.01); *B25D 17/06* (2013.01); *B25D 2217/0015* (2013.01); *B25D 2250/265* (2013.01)

(58) Field of Classification Search
CPC .. B25D 17/005; B25D 17/06; B25B 23/0035; B25B 21/02; Y10T 279/17068; Y10T 279/17051
USPC ..... 173/93.5
See application file for complete search history.

(56) References Cited

U.S. PATENT DOCUMENTS

2006/0225903 A1* 10/2006 Sterling ..... B25B 21/02 173/104
2007/0289760 A1* 12/2007 Sterling ..... B25F 5/00 173/104
2009/0014193 A1* 1/2009 Barezzani ..... B25B 21/02 173/93
2011/0056714 A1 3/2011 Elger et al.
2011/0233878 A1 9/2011 Wan et al.

FOREIGN PATENT DOCUMENTS

CN 205237922 U 5/2016
DE 202015007915 U1 11/2015

* cited by examiner

*Primary Examiner* — Nathaniel C Chukwurah
(74) *Attorney, Agent, or Firm* — Michael Best & Friedrich LLP

(57) ABSTRACT

An anvil for use with an impact wrench includes a first end, a second end opposite the first end, a shank adjacent the first end, and a head adjacent the second end. The shank includes a diameter and an outer cylindrical surface that defines a longitudinal axis that extends centrally through the anvil between the first end and the second end. The head includes a plurality of planar faces and an outer cylindrical surface. The outer cylindrical surface defines a diameter of the head. A ratio between the diameter of the shank and the diameter of the head is between approximately 1:1 and approximately 1.35:1.

20 Claims, 4 Drawing Sheets

ANVIL FOR AN IMPACT WRENCH

FIELD OF THE INVENTION

The present invention relates to power tools, and more specifically to impact wrenches.

BACKGROUND OF THE INVENTION

Anvil assemblies are typically used in power tools (e.g, electrically-operated power tools, pneumatic power tools, etc.) to transfer torque from a motor to a tool element to perform work on a workpiece. Particularly, impact wrenches utilize anvil assemblies to transfer a striking rotational force, or intermittent applications of torque, to the tool element and workpiece. As such, impact wrenches are typically used to loosen or remove stuck fasteners that are otherwise not removable or very difficult to remove using hand tools.

Typically, anvils used in anvil assemblies experience high stress levels due to the striking rotational force. The high stress levels may lead to fatigue failure in which a head of an anvil might fracture.

SUMMARY OF THE INVENTION

The invention provides, in one aspect, an impact wrench including a housing, a motor supported by the housing, an actuator operable to selectively energize the motor, a gear assembly coupled to the motor, and a drive assembly coupled to the gear assembly. The drive assembly is operable to convert a continuous rotational force provided by the gear assembly to a striking rotational force. The drive assembly includes an anvil to which the striking rotational force is applied. The anvil includes a first end, a second end opposite the first end, a shank proximate the first end, and a head proximate the second end. The shank includes a diameter and an outer cylindrical surface that defines a longitudinal axis that extends centrally through the anvil between the first end and the second end. The head includes a plurality of planar faces and an outer cylindrical surface. The outer cylindrical surface defines a diameter of the head. A ratio between the diameter of the shank and the diameter of the head is between approximately 1:1 and approximately 1.35:1.

The invention provides, in another aspect, an anvil for use with an impact wrench. The anvil includes a first end, a second end opposite the first end, a shank adjacent the first end, and a head adjacent the second end. The shank includes a diameter and an outer cylindrical surface that defines a longitudinal axis that extends centrally through the anvil between the first end and the second end. The head includes a plurality of planar faces and an outer cylindrical surface. The outer cylindrical surface defines a diameter of the head. A ratio between the diameter of the shank and the diameter of the head is between approximately 1:1 and approximately 1.35:1.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
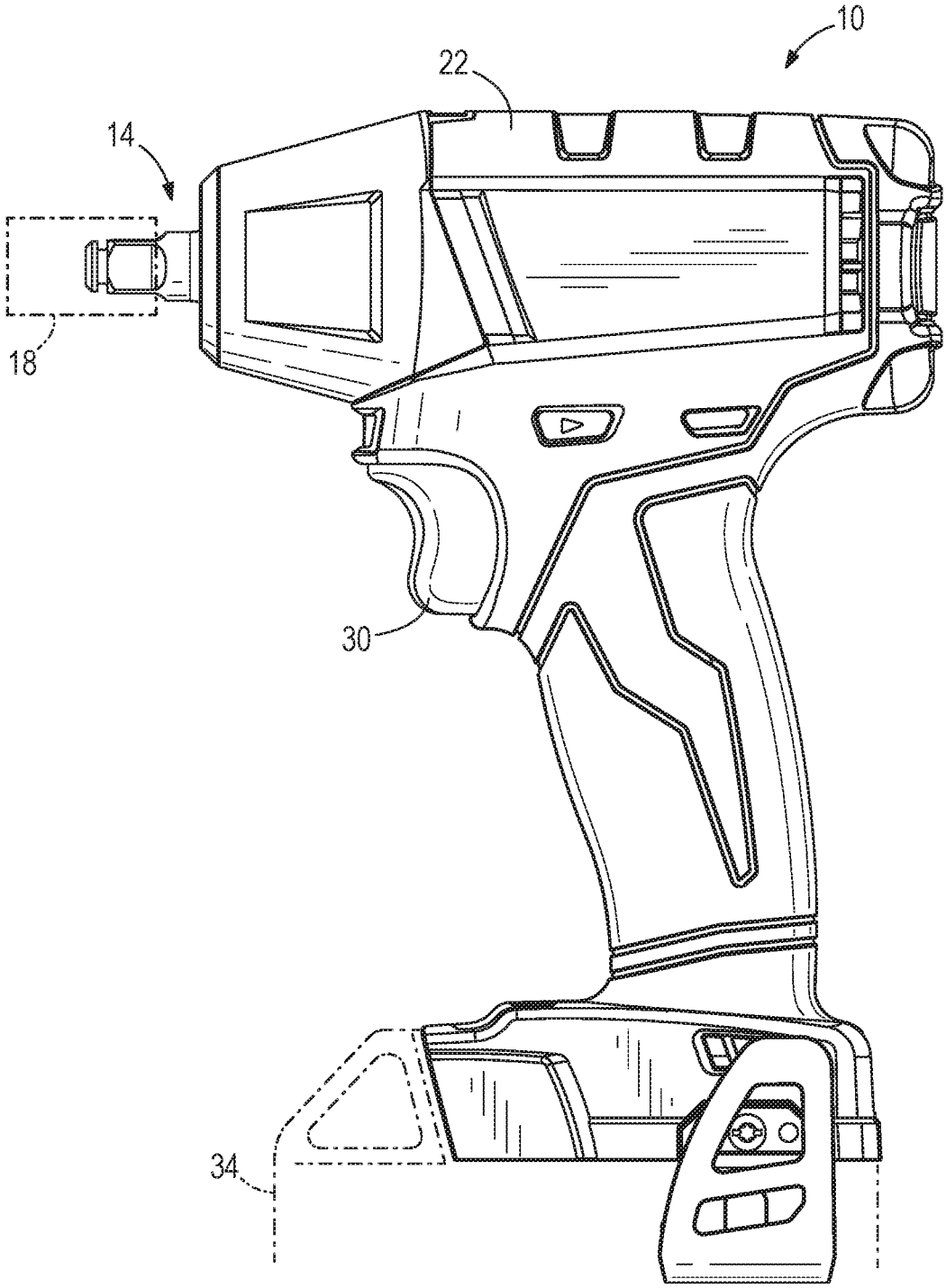
FIG. 1 is a side view of an impact wrench in accordance with an embodiment of the invention.
Figure 2:
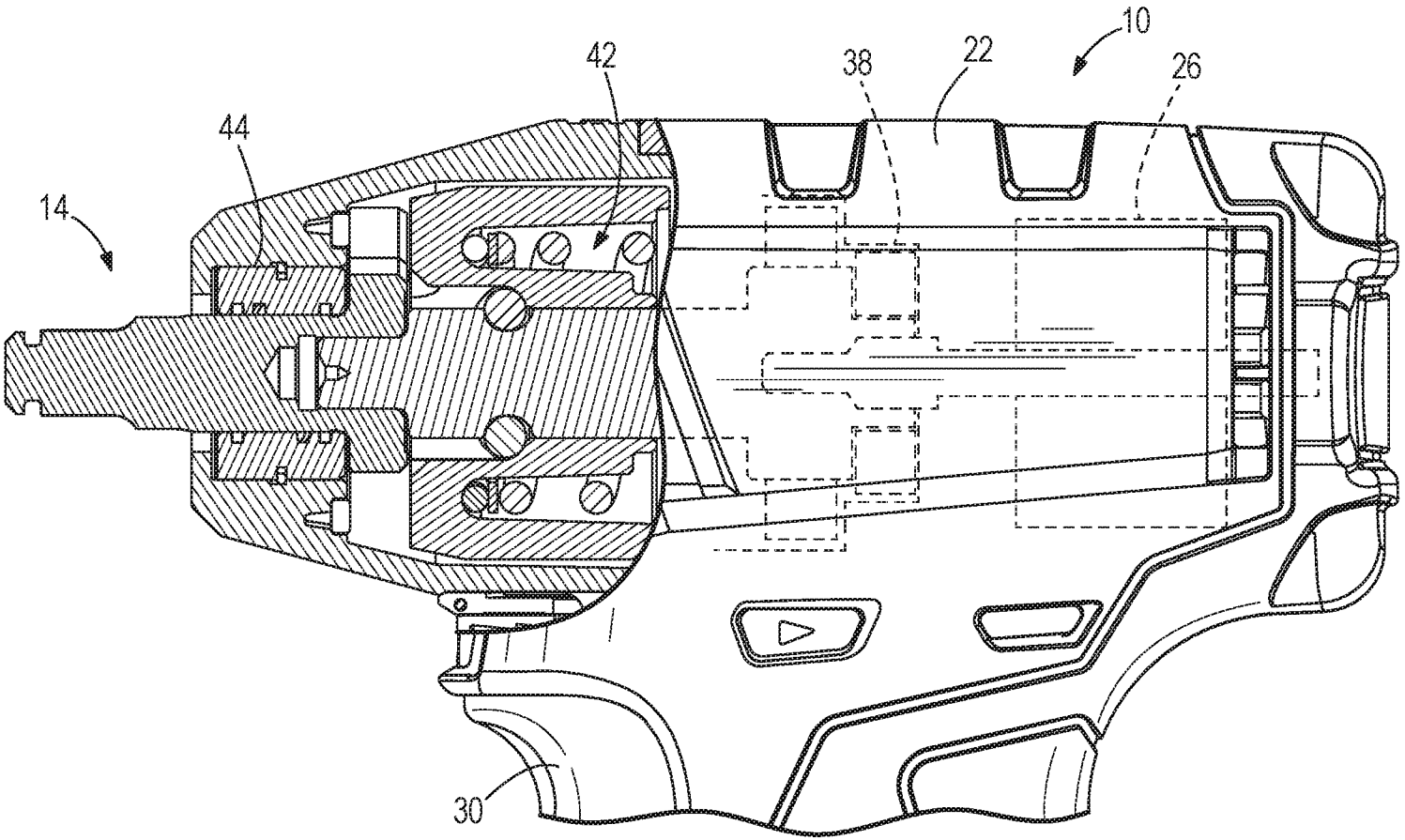
FIG. 2 is a partial cutaway view of the impact wrench of FIG. 1.

FIG. 1 illustrates an impact wrench 10 including an anvil 14 and a tool element 18 coupled to the anvil 14. Although the tool element 18 is schematically illustrated, the tool element 18 may include a socket configured to engage the head of a fastener (e.g., a bolt). Alternatively, the tool element 18 may include any of a number of different configurations (e.g., an auger or a drill bit) to perform work on a workpiece. With reference to FIGS. 1 and 2, the impact wrench 10 includes a housing 22 and a reversible electric motor 26 (FIG. 2) coupled to the anvil 14 to provide torque to the anvil 14 and the tool element 18. The impact wrench 10 also includes a switch (e.g., trigger switch 30) supported by the housing 22 and a battery pack 34 to supply power to the motor 26 (FIG. 1).

With reference to FIG. 2, the impact wrench 10 also includes a gear assembly 38 coupled to an output of the motor 26 and a drive assembly 42 coupled to an output of the gear assembly 38. The gear assembly 38 may be configured in any of a number of different ways to provide a speed reduction between the output of the motor 26 and an input of the drive assembly 42. The drive assembly 42, of which the anvil 14 may be considered a component, is configured to convert the continuous rotational force or torque provided by the gear assembly 38 to a striking rotational force or intermittent applications of torque to the tool element 18. U.S. Pat. No. 6,733,414, the entire contents of which is incorporated herein by reference, discloses in detail example configurations of the gear assembly 38 and portions of the drive assembly 42 between the anvil 14 and the gear assembly 38. The impact wrench 10 further includes a bushing 44 secured to the front of the housing 22 to rotatably support the anvil 14. Alternatively, a bearing (e.g., a roller or ball bearing) may be substituted for the bushing 44.

Figure 3:
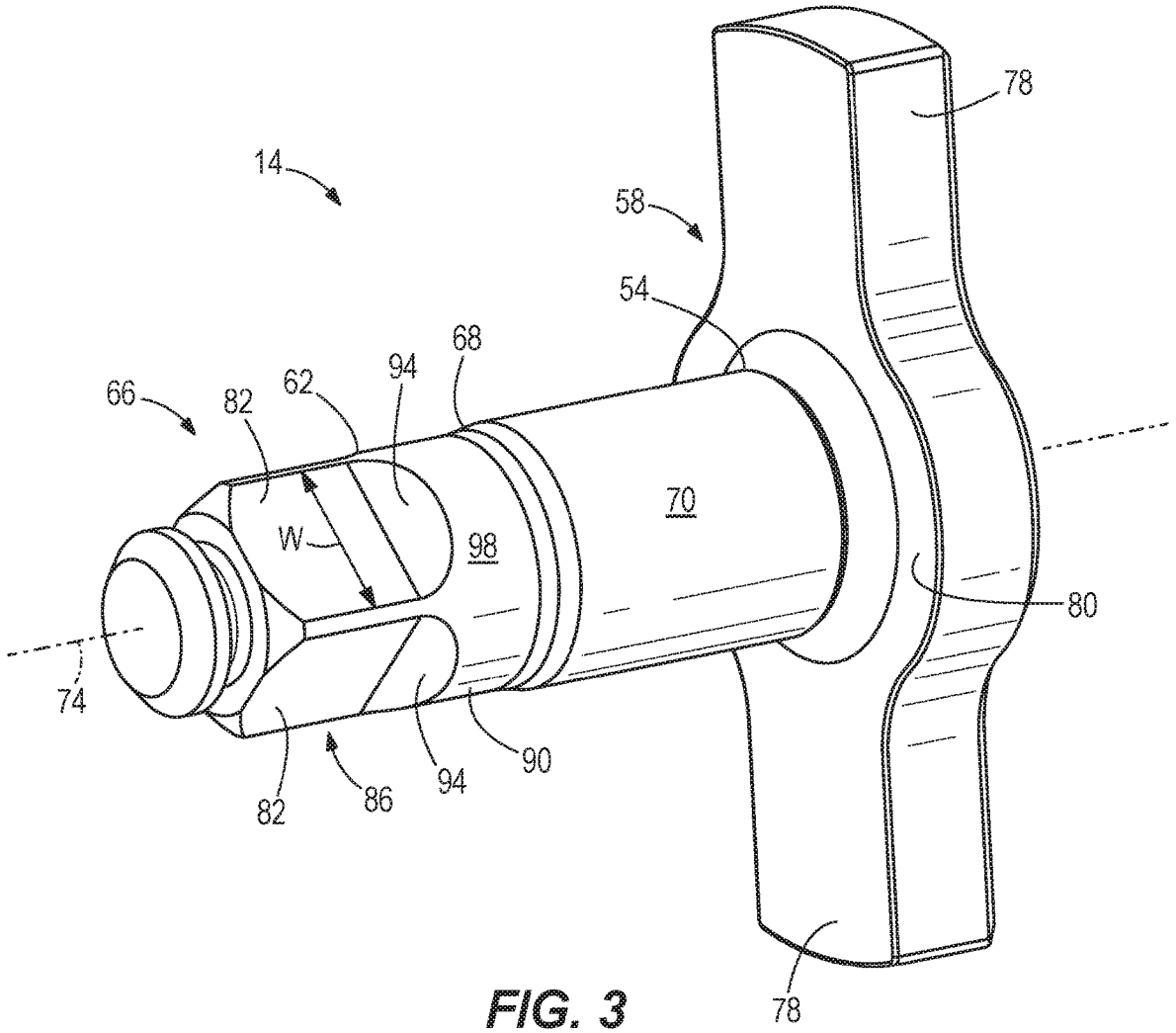
FIG. 3 is a perspective view of an anvil of the impact wrench of FIG. 1.
Figure 4:
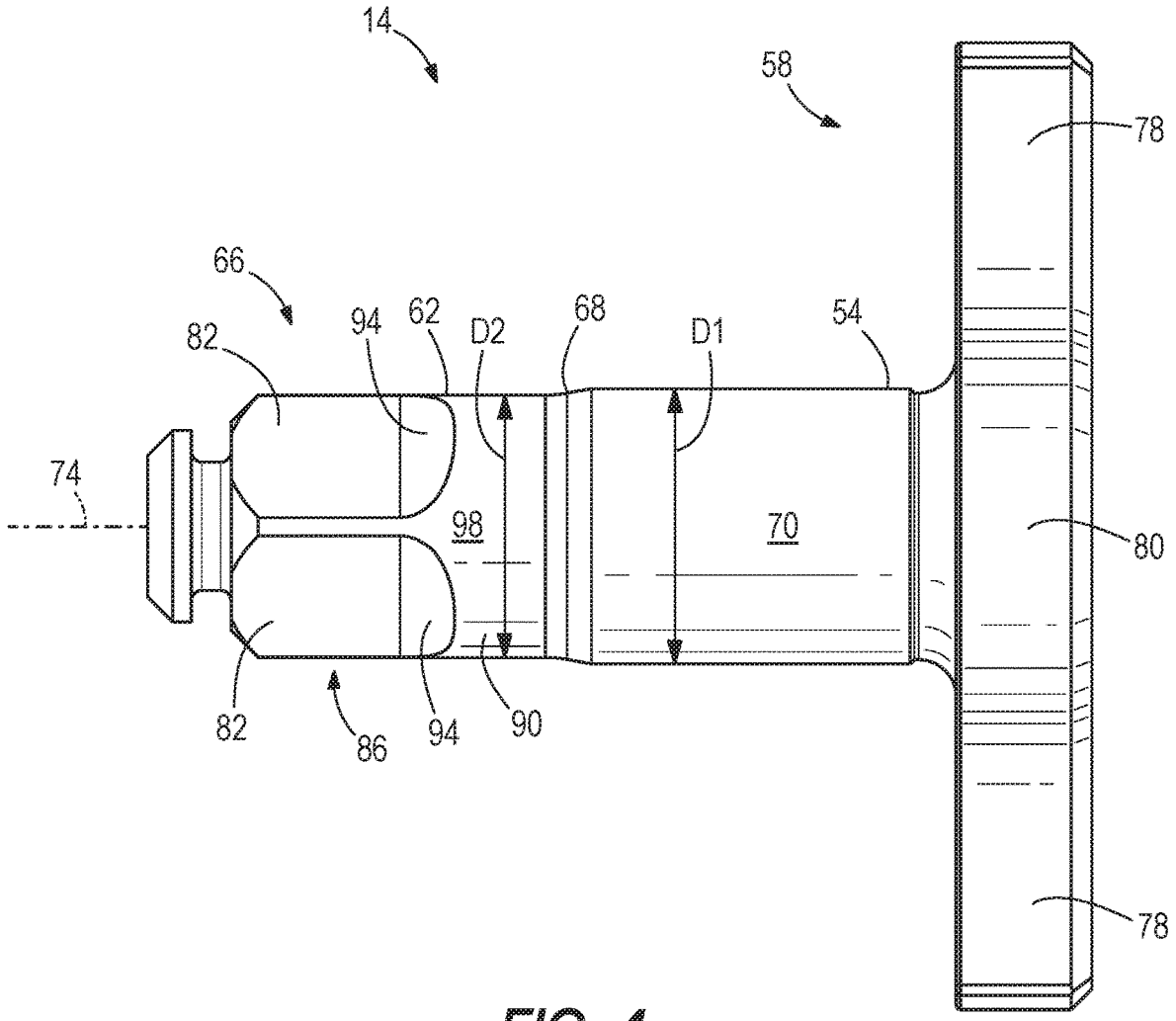
FIG. 4 is a side view of the anvil of FIG. 3.

With reference to FIGS. 3 and 4, the anvil 14 includes a shank 54 proximate a first end 58 of the anvil 14, a head 62 proximate a second end 66, and a transition zone 68 positioned between the shank 54 and the head 62. The shank 54 includes an outer cylindrical surface 70 defining a longitudinal axis 74 that extends centrally through the anvil 14 between the first and second ends 58, 66. The outer cylindrical surface 70 of the shank 54 also defines a diameter D1 (FIG. 4) of the shank 54. The shank 54 further includes a plurality of radially extending anvil lugs 78 extending from a flange 80. In the illustrated embodiment, the shank 54 includes two anvil lugs 78. In other embodiments, the shank 54 may include more than two anvil lugs 78.

With continued reference to FIGS. 3 and 4, the head 62 includes a plurality of substantially flat or planar surfaces 82 that, taken together, form a generally square portion 86 of the head 62 that is configured to receive the tool element 18. In the illustrated construction of the anvil 14, the head 62 includes four substantially planar surfaces 82, with adjacent substantially planar surfaces 82 oriented substantially normal to each other. Alternatively, the shape of the head 62 may be configured in any of a number of different ways to accept or receive tool elements 18 having corresponding-shaped apertures or recesses to receive the head 62. Further, in the illustrated embodiment, the planar surfaces 82 have a width W (FIG. 3) that corresponds to the size of the tool elements 18 to be fitted on the anvil 14. For example, the width W may be 0.375 inches corresponding to a tool element 18 having a nominal socket receptacle that is ⅜ inches in width. Similarly, the width W may be 0.5 inches or 1.0 inch corresponding to tool elements 18 having nominal socket receptacles that are 0.5 inches in width or 1 inch in width, respectively. The head 62 further includes a neck portion 90 positioned between the shank 54 and the square portion 86 and arcuate surfaces 94 that at least partially transition the neck portion 90 to each of the planar surfaces 82. The neck portion 90 includes an outer cylindrical surface 98 that is concentric with the outer cylindrical surface 70 of the shank 54. The outer cylindrical surface 98 defines a diameter D2 of the head 62 (FIG. 4).

As shown in FIGS. 3 and 4, the transition zone 68 at least partially transitions the outer cylindrical surface 70 of the shank 54 to the outer cylindrical surface 98 of the neck portion 90. The size (i.e., the area) of the transition zone 68 is proportional to the ratio between the diameter D1 of the shank 54 and the diameter D2 of the head 62. That is, a smaller ratio between the diameter D1 of the shank 54 and the diameter D2 of the head 62 yields a smaller (i.e., having a numerically lower value of area) transition zone 68, which in turn reduces the stress between the shank 54 and the head 62 during operation of the impact wrench 10 and increases the life of the anvil 14.

In the illustrated embodiment, the diameter D1 is larger than the diameter D2. In other embodiments, the diameter D1 is the same size as the diameter D2, which effectively eliminates the transition zone 68. Preferably, a ratio between the diameter D1 of the shank 54 and the diameter D2 of the head 62 is between approximately 1:1 and approximately 1.35:1 to minimize the stress within the anvil 14 during operation of the impact wrench. In some embodiments where the width W is 0.375 inches, a diameter D1 of about 16 mm or less reduces the stress within the anvil 14, and specifically the stress between the shank 54 and the head 62, during operation of the impact wrench 10. In further embodiments where the width W is 0.375 inches, a diameter D1 of 13.2 mm and a diameter D2 of 12.6 mm reduces the stress within the anvil 14, and specifically the stress between the shank 54 and the head 62, during operation of the impact wrench 10.

During operation of the impact wrench 10, a user squeezes the trigger switch 30 to energize the motor 26. The motor 26 drives the gear assembly 38 and the drive assembly 42 transfers the continuous rotational force from the gear assembly 38 to a striking or intermittent rotational force through the anvil 14 to the tool element 18. The striking rotational force produces stress within the anvil 14.

Providing an anvil 14 with a ratio of diameters D1:D2, as described above, between approximately 1:1 and approximately 1.35:1 reduces the amount of stress developed between the shank 54 and the head 62, thus increasing the useful life of the anvil 14. It has been found that a ratio of diameters D1:D2, as described above, greater than 1.35:1 yields higher stress within the anvil 14 between the shank 54 and the head 62, increasing the likelihood that the square portion 86 of the head 62 fracture and break from the shank 54. As the ratio of diameters D1:D2 approaches 1:1, it has been found that the stress within the anvil 14, and specifically stress between the shank 54 and the head 62, is reduced, thus increasing the useful life of the anvil 14.

Various features and advantages of the invention are set forth in the following claims.

What is claimed is:

1. An impact wrench comprising:
- a housing;
- a motor supported by the housing;
- an actuator operable to selectively energize the motor;
- a gear assembly coupled to the motor; and
- a drive assembly coupled to the gear assembly, the drive assembly operable to convert a continuous rotational force provided by the gear assembly to a striking rotational force;
- wherein the drive assembly includes an anvil to which the striking rotational force is applied, wherein the anvil comprises
  - a first end,
  - a second end opposite the first end,
  - a shank proximate the first end, the shank having a diameter and an outer cylindrical surface that defines a longitudinal axis that extends centrally through the anvil between the first end and the second end, and
  - a head proximate the second end, the head including a plurality of planar faces and an outer cylindrical surface, the outer cylindrical surface defining a diameter of the head;
- wherein a ratio between the diameter of the shank and the diameter of the head is between approximately 1:1 and approximately 1.35:1.

2. The impact wrench of claim 1, wherein the diameter of the shank is less than 16 mm.

3. The impact wrench of claim 1, wherein each of the planar surfaces has a width of 0.375 inches.

4. The impact wrench of claim 3, wherein the diameter of the shank is 13.2 mm, and wherein the diameter of the head is 12.6 mm.

5. The impact wrench of claim 1, wherein each of the planar surfaces has a width of 0.5 inches.

6. The impact wrench of claim 1, wherein each of the planar surfaces has a width of 1 inch.

7. The impact wrench of claim 1, wherein the plurality of planar surfaces includes four planar surfaces on the head of the anvil, and wherein adjacent planar surfaces on the head, are disposed substantially normal to each other.

8. The impact wrench of claim 1, wherein the anvil includes a transition zone between the shank and the head.

9. The impact wrench of claim 8, wherein the area of the transition zone decreases as the ratio between the diameter of the shank and the diameter of the head decreases.

10. The impact wrench of claim 1, wherein the anvil includes a plurality of radially-extending lugs extending from the shank at the first end of the anvil.

11. An anvil for use with an impact wrench, the anvil comprising:
- a first end;
- a second end opposite the first end;
- a shank proximate the first end, the shank having a diameter and an outer cylindrical surface that defines a longitudinal axis that extends centrally through the anvil between the first end and the second end; and
- a head proximate the second end, the head including a plurality of planar faces and an outer cylindrical surface, the outer cylindrical surface defining a diameter of the head;

wherein a ratio between the diameter of the shank and the diameter of the head is between approximately 1:1 and approximately 1.35:1.

12. The anvil of claim 11, wherein the diameter of the shank is less than 16 mm.

13. The anvil of claim 11, wherein each of the planar surfaces has a width of 0.375 inches.

14. The anvil of claim 13, wherein the diameter of the shank is 13.2 mm, and wherein the diameter of the head is 12.6 mm.

15. The anvil of claim 11, wherein each of the planar surfaces has a width of 0.5 inches.

16. The anvil of claim 11, wherein each of the planar surfaces has a width of 1 inch.

17. The anvil of claim 11, wherein the plurality of planar surfaces includes four planar surfaces on the head, and wherein adjacent planar surfaces are disposed substantially normal to each other.

18. The anvil of claim 11, further comprising a transition zone between the shank and the head.

19. The anvil of claim 18, wherein the area of the transition zone decreases as the ratio between the diameter of the shank and the diameter of the head gets decreases.

20. The anvil of claim 11, further comprising a plurality of radially-extending lugs extending from the shank at the first end.

* * * * *